US005617785A

United States Patent [19]

Lo

[11] Patent Number: 5,617,785

[45] Date of Patent: Apr. 8, 1997

[54] EMBOSSING MACHINE

[76] Inventor: Wen C. Lo, No. 4, Lane 155, Sec. 6, Yen Ping N. Rd., Shih Lin District, Taiwan

[21] Appl. No.: 568,141

[22] Filed: Dec. 6, 1995

[51] Int. Cl.[6] ..... B31F 1/07

[52] U.S. Cl. ..... 101/3.1; 101/27; 101/31.1

[58] Field of Search ..... 101/3.1, 27, 28, 101/31, 31.1, 316

[56] References Cited

U.S. PATENT DOCUMENTS

| | | | |
|---|---|---|---|
| 3,435,760 | 4/1969 | Harrison | 101/27 |
| 4,542,690 | 9/1985 | Kikuchi | 101/27 |
| 4,622,897 | 11/1986 | Laverick et al. | 101/316 |
| 5,127,320 | 7/1992 | Mei | 101/3.1 |
| 5,461,976 | 10/1995 | Forehand | 101/31.1 |

FOREIGN PATENT DOCUMENTS

| | | | |
|---|---|---|---|
| 0975330 | 3/1951 | France | 101/3.1 |
| 0470029 | 4/1953 | Italy | 101/3.1 |
| 63-53089 | 3/1988 | Japan | 101/3.1 |

*Primary Examiner*—Christopher A. Bennett

*Attorney, Agent, or Firm*—David & Raymond; Raymond Y. C. Chan

[57] ABSTRACT

An embossing machine includes a frame, a top magnet, die disk, and a bottom magnet. The top magnet has a top die cavity, a fixed hook, a handle and a bracket on the upper portion, and a bottom die cavity in the lower portion, wherein the top die cavity has a step circular surface which has a plurality of sliced screw holes formed in the top circumference and has a first elastic element disposed therein. The top magnet attracts a top die engaged with the top die cavity through a key and a key way formed thereof, wherein the top magnet has a bolt fixed therein and a second elastic element disposed inside. The die disk is engaged with the bolt on the top magnet, wherein the die disk has a gear fixed thereon and a plurality of sliced screw holes formed on the circumference for engaging with the top die cavity. The die disk further has an adjusting bolt which has a thorough opening therein to engage with the bolt on the top magnet, wherein the adjusting bolt has a bushing, a washer and a screw disposed at one end. The bottom magnet for attracting a bottom die disposed in said bottom die cavity is engaged with said frame via a second key and a second key way formed thereof.

16 Claims, 5 Drawing Sheets

EMBOSSING MACHINE

BACKGROUND OF THE PRESENT INVENTION

1. Field of the Invention

The present invention relates to embossing machine and particularly to an embossing machine which can either be activated by electric power with the bottom die moving upward and the top die remaining stationary or be operated manually with a press handle to move the top die downward while the bottom die remains stationary.

2. Description of the Prior Art

FIG. 1 illustrates a conventional manual embossing machine which in general includes a C shape frame 1, a feeding means 2 composed of a worm shaft 20, a worm pear 21, a top die 3, and a bottom die 4. The top die 3 is disposed under an upper fixed part 10 located above the gap of the frame 1 while the bottom die 4 is disposed on a lower fixed part 11 located below the gap of the frame 1. An embossing object A is placed on the bottom die 4. Lever 22 is then moved downward to turn the worm gear 21 which makes the worm shaft 20 moving linearly downward to press on the bottom die 4. Thus object A is pressed by the top die 3 and bottom die 4 to form figures or patterns on both faces of object A.

FIG. 2 illustrates another conventional manual embossing machine which uses every mechanism without worm gear or worm shaft. It is generally structured as shown in FIG. 1 although it is simpler in structure.

There are some disadvantages in the conventional embossing machines:

1. The top and bottom dies are rigidly disposed on the fixed parts, therefore they cannot be adjusted horizontally or vertically.

2. Because the embossing object is disposed rigidly, the grain depth and dimension of the object is restricted.

3. Manual operation could result in non-consistent embossing quality.

4. Manual operation is also slow and not efficient.

There are electric embossing machines developed to resolve the shortcomings of the manual embossing machine. FIG. 3 and 4 illustrate two of the examples. However electric embossing machine generally occupies large space and creates a high degree of tear and wear on the contact pans. It also needs highly skilled operator to adjust the gap and stamping angle. Therefore, it still can not reach a high degree of practicality.

SUMMARY OF THE PRESENT INVENTION

The main object of the present invention is to provide an embossing machine which can be activated electrically or manually. When activated electrically, the bottom die is moved upward while the top die remains stationary. When operated manually, the top die is moved downward while the bottom die remains stationary.

Another object of the present invention is to provide an embossing machine which uses magnetic field to keep the top and bottom dies in position. The horizontal angle of top and bottom dies can be adjusted readily. A limit-switch is used to control the pressing stroke.

Another object of the present invention is to provide an embossing machine which has a turnable gear disposed on the top die for adjusting the pressure of the elastic element, and thus it enables the embossing object to obtain the best possible result without adjusting the gap between the top and bottom dies.

It is yet another object of the present invention to provide an embossing machine which has an adjusting screw to adjust the gap between the top and bottom dies to achieve the best possible embossing result.

This invention thus able to provide a continuous and smooth embossing operation regardless if the electric power is available or not.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
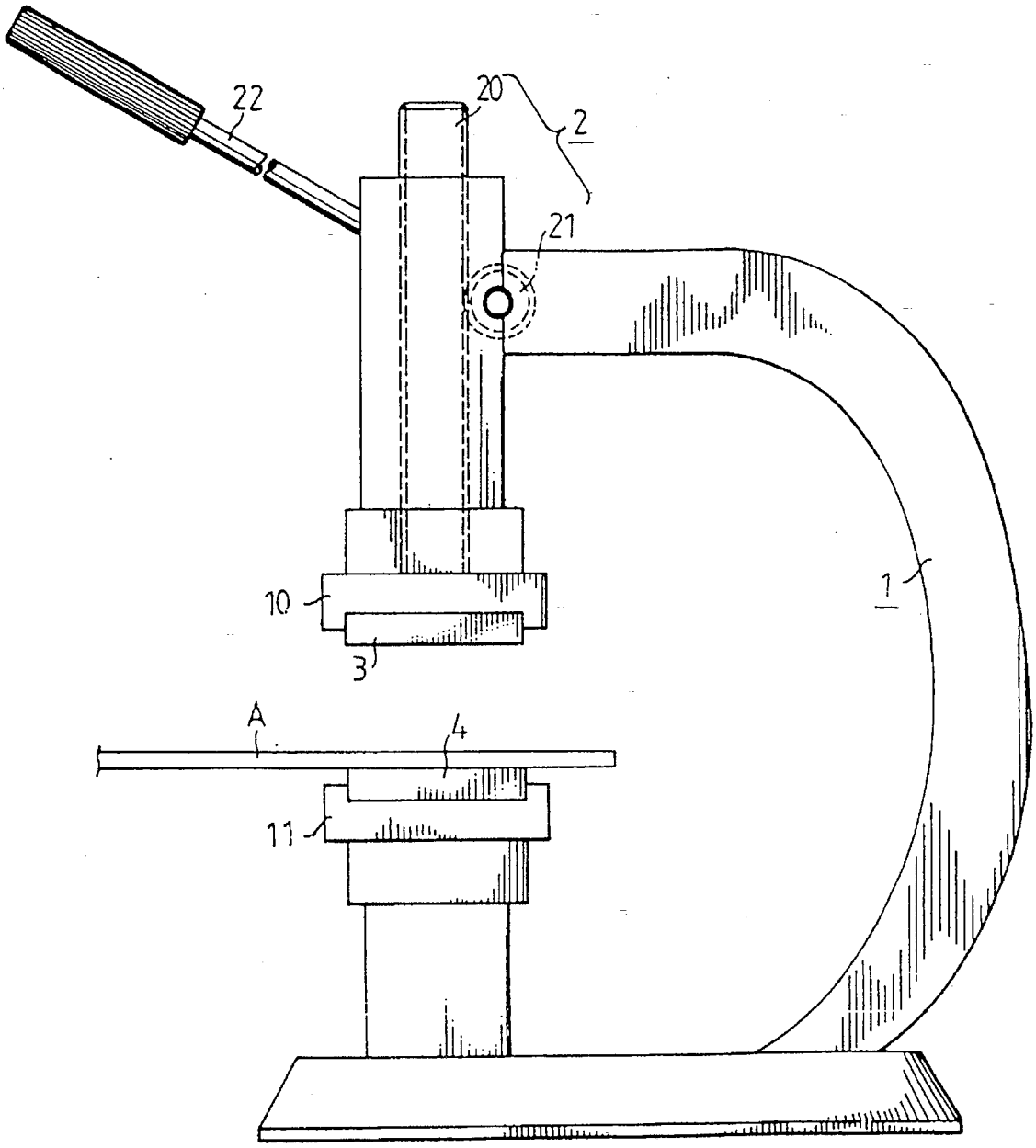
FIG. 1 PRIOR ART
FIG. 1 is a side view of a conventional manual embossing machine.
Figure 2:
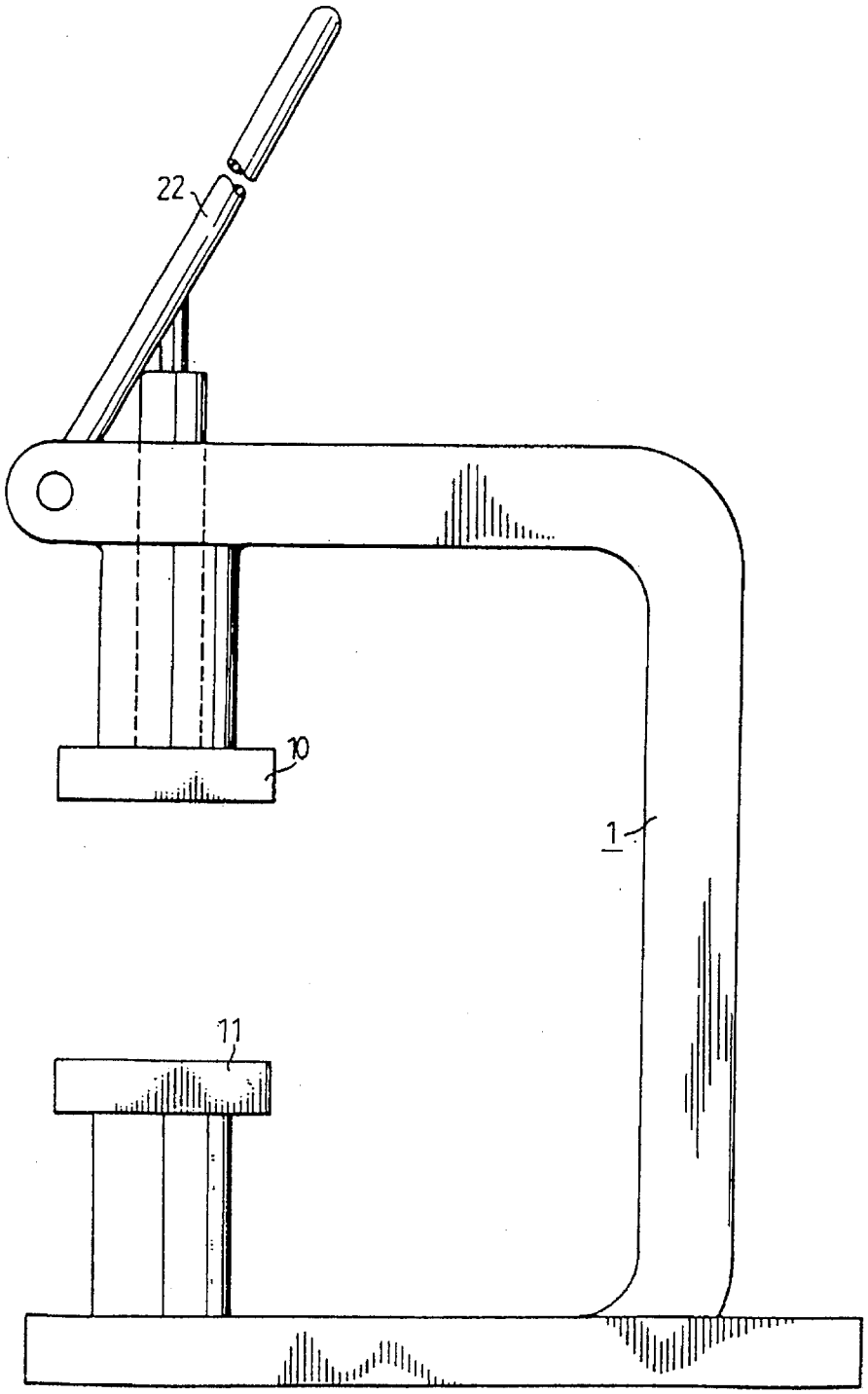
FIG. 2 PRIOR ART
FIG. 2 is a side view of another conventional manual embossing machine.
Figure 4:
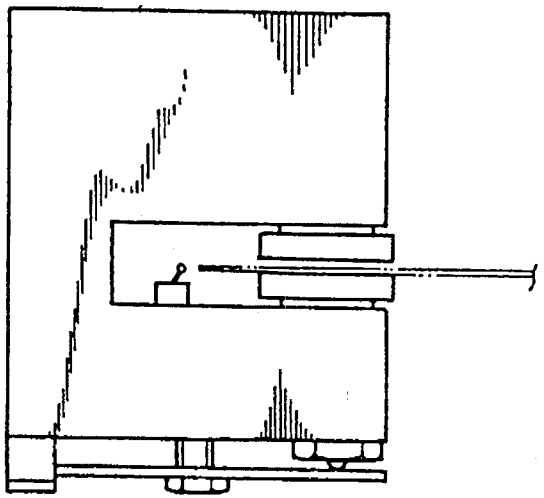
FIG. 4 PRIOR ART
FIG. 4 is a side view of a conventional electric embossing machine.
Figure 3:
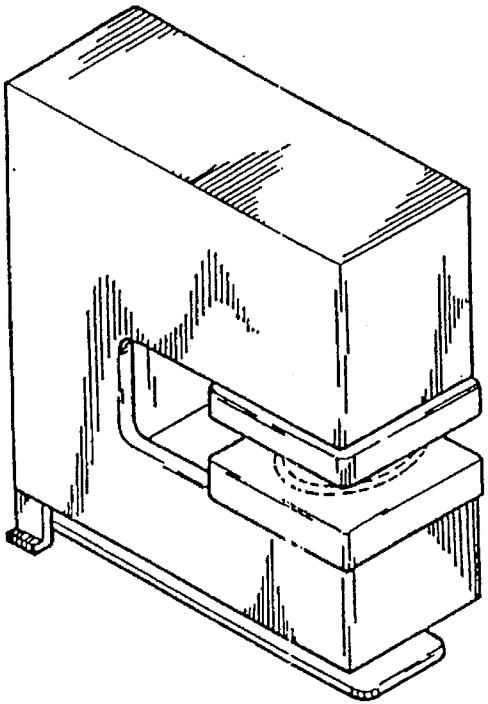
FIG. 3 PRIOR ART
FIG. 3 is a perspective view of a conventional electric embossing machine.
Figure 5:
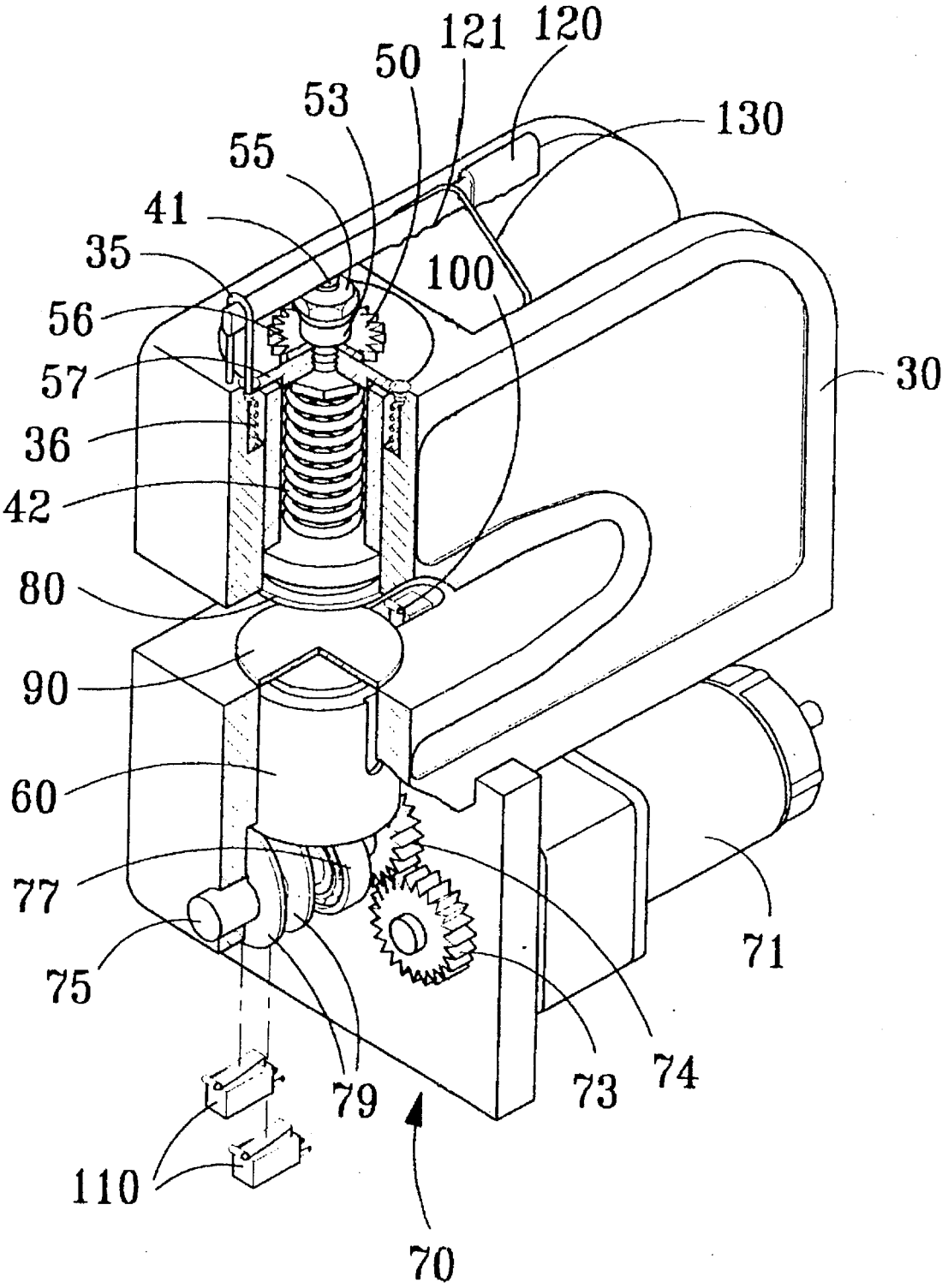
FIG. 5 is a perspective view, partly cutaway, of the present invention.
Figure 6:
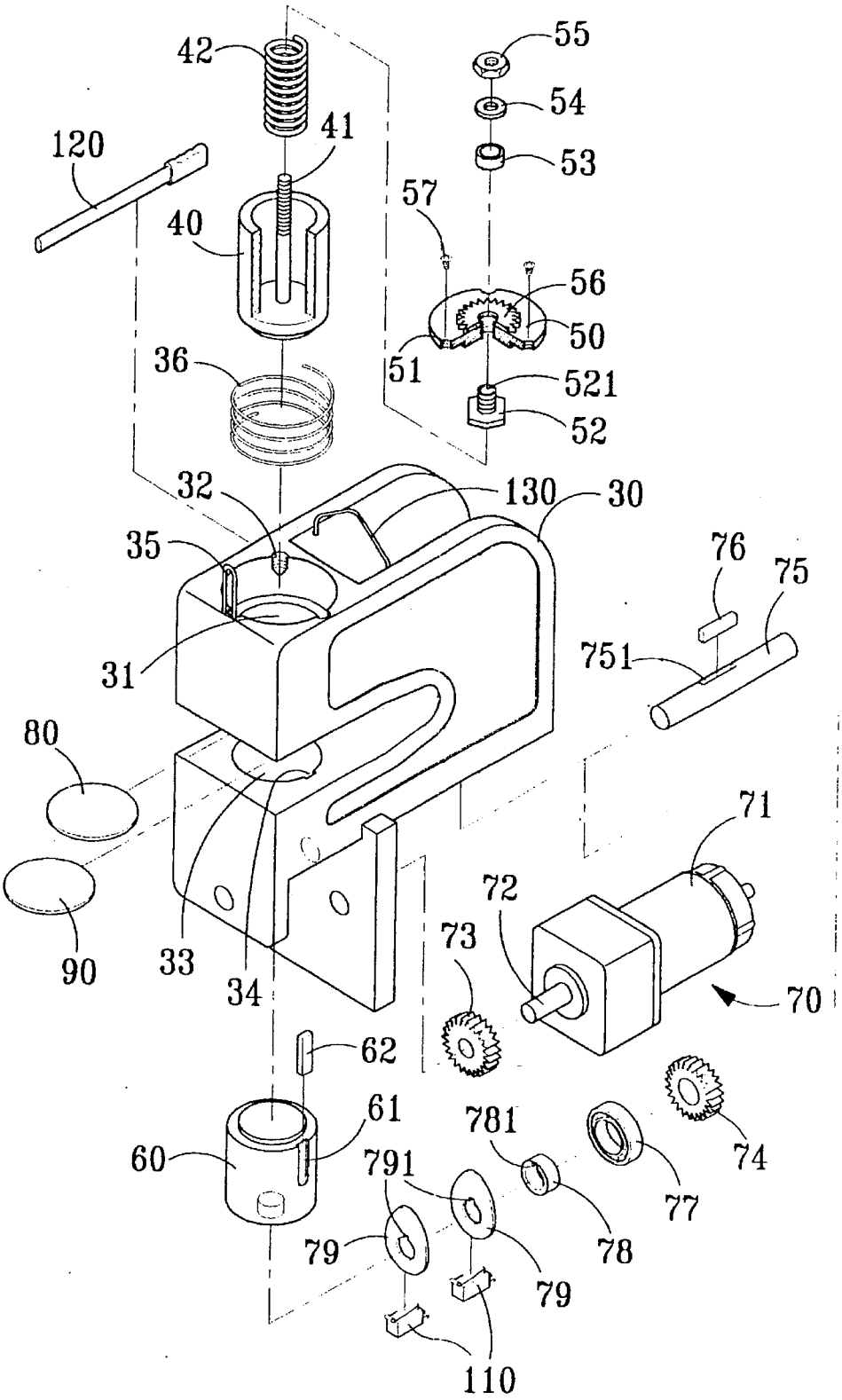
FIG. 6 is an exploded view of the present invention.

Referring to FIG. 5 and 6, an embossing machine of the present invention includes a frame 30 which has a limit-switch 100, a top die cavity 31 which has a step internal surface. On the stop circumference of the top die cavity 31, there are a plurality of sliced screw holes 32. In the larger step surface of the cavity 31, there is a first elastic element 36 disposed therein. In the smaller step surface of cavity 31, there is a key way formed therein. A top magnet 40 is disposed inside the top die cavity 31. Top magnet 40 has a key seat (not shown in the figures) formed on the circumference which matches against the key way in the top die cavity 31. A key is engaged with the key way and the key seat. The top magnet 40 may be shaped in cylindrical, elliptic or square form. There is a bolt 41 disposed within the magnet 40. A second elastic element 42 is disposed inside the top magnet 40. A die disk 50 is disposed on the top of the magnet 40.

The die disk 50 may be shaped in circular, ellipse or square. A gear 56 is attached on the top surface of the die disk 50. There are a plurality of sliced screw holes 51 formed on the circumference of the die disk 50. Thus the die disk 50 can be fixed on the top die cavity 31 by engaging screw 57 with screw holes 51 and 32.

On the die disk 50, there is a bolt 52 which has a through opening 521 formed inside and is engagable with the bolt 41. A bush 53, a washer 54 and a screw 55 are engaged with the bolt 41 and are located above the die disk 50 respectively.

There is a bottom magnet 60 which may be in cylindrical, elliptic or square shape. There is a key seat 61 formed on the outside circumference and is engaged through a key and with a key way 34 formed on the inside surface of a bottom die cavity 33.

The magnet 60 is driven by a transmission mechanism 70 which comprises a motor 71, a spindle 72 and a gear 73 which in turn engages with a driven gear 74 disposed on a transmission shaft 75. The transmission shaft 75 has a key seat 75 1, which engages with a bearing 77, an eccentric wheel 78 and a cam 79 through a key 76 via key ways 781 and 791 respectively. The motor 71 is controlled by a predetermined number of micro switch 110. IN another alternative, the motor 71 may directly drive the transmission shaft 75 or via a clutch (not shown) installed on the transmission shaft.

When in use, a top die 80 and a bottom die 90 are placed on the bottom magnet 60. The top magnet 40 and the bottom magnet 60 are then moved close to each other to attract respectively the top die 80 and the bottom die 90. When separating the magnets 40 and 60 again, a gap is formed between the top die 80 and the bottom die 90 to allow an object be placed therebetween for embossing purpose. The horizontal angle of the dies 80 and 90 can be changed and adjusted freely by turning the screw 55 when needed. A micro switch 100 is used to activate the motor 71 for embossing operation. The gap between the dies 80 and 90 can be changed and adjusted by moving the position of the micro switch 100.

Upon turning the gear 56 on the die disk 50, the pressure of the elastic element 42 will also be changed, thus the pressing pressure applied on the embossing object can be adjusted without changing the gap between the top die 80 and bottom die 90. When the turning screw 55, the gap between the dies 80 and 90 can be changed to suit various thickness of embossing objects to get the most desirable pressing effect.

To facilitate manual operation when there is no electric power, there is provided a fixed hook 35 and a bracket 130 on the upper surface of the frame 30. A movable press handle 120 is engaged with both the hook 35 and the bracket 130, in which the hook 35 serves as a pivot point. When in use, press the handle 120 downward which applies force on the top magnet 41 and the top die 80 downward against the bottom die 90 to perform embossing function. Releasing the downward pressure from the handle 120, the elastic element 36 will move the top die 80, the top magnet 40, the die disk 50, and the handle 120 upward to their original positions. Thus the present invention can be operated either when the electricity is available or absent, and making it versatile and working smoothly.

Many changes and modifications in the above described embodiment of the invention can, of course, be carried out without departing from the scope thereof. Accordingly, to promote the progress in science and the useful arts, the invention is disclosed and is intended to be limited only be the scope of the appended claims.

I claim:

1. An electric embossing machine, comprising a frame having an upper portion and a lower portion, in which said upper portion has a top die cavity and said lower portion has a bottom die cavity, wherein said top die cavity has a top circumference and a step circular surface which has a plurality of sliced screw holes formed in said top circumference and has a first elastic element disposed therein;

a top magnet for attaching a top die engaged with said top die cavity, wherein said top magnet has a bolt fixed therein and a second elastic element disposed inside said top magnet;

a die disk engaging with said bolt on said top magnet, wherein said die disk has a gear fixed thereon and a plurality of sliced screw holes formed on a circumference of said die disk for engaging with said top die cavity, said die disk further having an adjusting bolt which has a through opening therein to engage with said bolt on said top magnet, wherein said adjusting bolt has a bushing, a washer and a screw disposed on one end thereof;

a bottom magnet for attaching a bottom die disposed in said bottom die cavity, wherein a key way is formed on an inside surface of said bottom die cavity and a key seat is formed on an outside circumference of said bottom magnet, and that a key is engaged between said key seat and said key way for engaging said bottom magnet inside said bottom die cavity; and a transmission mechanism including a motor and a transmission shaft connected with said motor, and that an eccentric wheel and a cam are disposed on said transmission shaft.

2. An electric embossing machine, as recited in claim 1, further having a limit-switch for activating the embossing operation, wherein the position of said limit-switch is able to be adjusted to suit the size of an embossing object.

3. An electric embossing machine, as recited in claim 1, wherein said motor further comprises spindle and a gear attached on said spindle, said transmission shaft having a driven gear disposed thereon and engaged with said gear of said motor.

4. An electric embossing machine, as recited in claim 2, wherein said motor further comprises spindle and a gear attached on said spindle, said transmission shaft having a driven gear disposed thereon and engaged with said gear of said motor.

5. An electric embossing machine, as recited in claim 1, wherein said top die and said bottom die are positioned by magnetic field and are changeable in horizontal angle.

6. An electric embossing machine, as recited in claim 1, wherein said top magnet, said disk and said bottom magnet is in, ellipse shape.

7. An electric embossing machine, as recited in claim 1, wherein said top magnet, said disk and said bottom magnet is in square shape.

8. An electric embossing machine, as recited in claim 4, wherein said top magnet, said disk and said bottom magnet is in ellipse shape.

9. An electric embossing machine, as recited in claim 4, wherein said top magnet, said disk and said bottom magnet is in circular shape.

10. An electric embossing machine, as recited in claim 4, wherein said top magnet, said disk and said bottom magnet is in ellipse shape.

11. An electric embossing machine, as recited in claim 4, wherein said top magnet, said disk and said bottom magnet is in square shape.

12. A manual embossing machine, comprising a frame having an upper portion and a lower portion, in which said upper portion has a top die cavity, a fixed hook, a handle, and a bracket, and said lower portion has a bottom die cavity, wherein said top die cavity has a top circumference and a step circular surface which has a plurality of sliced screw holes formed in said top circumference and has a first elastic element disposed therein;

a top magnet for attaching a top die engaged with said top die cavity, wherein said top magnet has a bolt fixed therein and a second elastic element disposed inside said top magnet;

a die disk engaging with said bolt on said top magnet, wherein said die disk has a gear fixed thereon and a plurality of sliced screw holes formed on a circumference of said die disk for engaging with said top die cavity, said die disk further having an adjusting bolt which has a through opening therein to engage with said bolt on said top magnet, wherein said adjusting bolt has a bushing, a washer and a screw disposed on one end thereof; and a bottom magnet for attaching a bottom die disposed in said bottom die cavity, wherein a key way is formed on an inside surface of said bottom die cavity and a key seat is formed on an outside circumference of said bottom magnet, and that a key is engaged between said key seat and said key way for engaging said bottom magnet inside said bottom die cavity.

13. A manual embossing machine, as recited in claim 12, wherein said top die and said bottom die are positioned by magnetic field and are changeable in horizontal angle.

14. A manual embossing machine, as recited in claim 12, wherein said top magnet, said disk and said bottom magnet is in circular shape.

15. A manual embossing machine, as recited in claim 12, wherein said top magnet, said disk and said bottom magnet is in circular shape.

16. A manual embossing machine, as recited in claim 12, wherein said top magnet, said disk and said bottom magnet is in square shape.

* * * * *